US007217083B2

(12) United States Patent
Yasuda et al.

(10) Patent No.: US 7,217,083 B2
(45) Date of Patent: May 15, 2007

(54) REGENERATIVE PUMP HAVING BLADES RECEIVED IN FLUID PASSAGE

(75) Inventors: Masanori Yasuda, Okazaki (JP); Shinichi Yokoyama, Gifu (JP)

(73) Assignees: Nippon Soken, Inc. (JP); Denso Corporation (JP)

( * ) Notice: Subject to any disclaimer, the term of this patent is extended or adjusted under 35 U.S.C. 154(b) by 185 days.

(21) Appl. No.: 10/921,163

(22) Filed: Aug. 19, 2004

(65) Prior Publication Data

US 2005/0047903 A1 Mar. 3, 2005

(30) Foreign Application Priority Data

Aug. 26, 2003 (JP) ..... 2003-301184

(51) Int. Cl.
*F04D 29/42* (2006.01)

(52) U.S. Cl. ..... 415/55.1

(58) Field of Classification Search ..... 415/55.1, 415/55.5

See application file for complete search history.

(56) References Cited

U.S. PATENT DOCUMENTS 5,372,475 A * 12/1994 Kato et al. ..... 415/55.1
5,599,163 A * 2/1997 Heath et al. ..... 415/55.1
6,454,522 B2 * 9/2002 Sakamoto et al. ..... 415/55.1

FOREIGN PATENT DOCUMENTS

JP 7-119686 5/1995

* cited by examiner

*Primary Examiner*—Edward K. Look
*Assistant Examiner*—Devin Hanan
(74) *Attorney, Agent, or Firm*—Nixon & Vanderhye PC

(57) ABSTRACT

A casing of a regenerative pump forms a generally annular fluid passage, which conducts a fluid. An impeller is rotatably received in the casing and has a plurality of blades, which are arranged one after another in a circumferential direction to provide kinetic energy to the fluid in the fluid passage upon rotation of the impeller. The regenerative pump satisfies a relationship of $0.60 \leqq b/a \leqq 0.76$, where "a" is an axial width of each blade, and "b" is a total axial distance, which is a sum of a first axial distance between a first axial side outer edge of the blade and an opposed first axial side inner wall of the fluid passage and a second axial distance between a second axial side outer edge of the blade and an opposed second axial side inner wall of the fluid passage.

4 Claims, 7 Drawing Sheets

REGENERATIVE PUMP HAVING BLADES RECEIVED IN FLUID PASSAGE

CROSS REFERENCE TO RELATED APPLICATION

This application is based on and incorporates herein by reference Japanese Patent Application No. 2003-301184 filed on Aug. 26, 2003.

BACKGROUND OF THE INVENTION

1. Field of the Invention

The present invention relates to a regenerative pump.

2. Description of Related Art

The regenerative pump is a pump, in which a plurality of blades is driven in an annular fluid passage to provide kinetic energy to a fluid supplied into the fluid passage. The regenerative pump is used to, for example, supply air to exhaust gas discharged from an internal combustion engine to reduce emissions contained in the exhaust gas.

One type of regenerative pump is recited in, for example, Japanese Unexamined Patent Publication No. 7-119686 or FIG. 8. This type of regenerative pump will be described with reference to FIG. 8. In FIG. 8, a blade passing zone cross sectional area of a fluid passage of the regenerative pump 100 has a semi-round shape, and a blade non-passing zone cross sectional area of the fluid passage also has a semi-round shape. Here, the blade passing zone cross sectional area is defined as a portion of a cross section of the fluid passage, through which the blades 101 pass through. Here, the cross section of the fluid passage is perpendicular to a flow direction of a mainstream of the fluid in the fluid passage. Furthermore, the blade non-passing zone cross sectional area is defined as a portion of the cross section of the fluid passage, through which the blades 101 do not pass. Another type of regenerative pump is recited in, for example, Japanese Unexamined Patent Publication No. 7-119686 or FIG. 9. This type of regenerative pump will be described with reference to FIG. 9. In FIG. 9, the blade passing zone cross sectional area of the regenerative pump 100 has a generally quarter-round shape, and the blade non-passing zone cross sectional area of the regenerative pump 100 has a shape that includes a semi-round portion and a linear portion. The linear portion extends from one end of the semi-round portion.

With reference to FIGS. 10 and 11, which show partial enlarged views of FIGS. 8 and 9, respectively, the fluid supplied into the regenerative pump 100 receives kinetic energy from the blades 101. Thus, the fluid sequentially moves from one to the next recess, each of which is defined between corresponding adjacent blades 101, while the fluid swirls between a blade passing zone and a blade non-passing zone. Here, the blade passing zone is defined as a portion of the fluid passage, through which the blades 101 pass. Also, the blade non-passing zone is defined as a portion of the fluid passage, through which the blades 101 do not pass.

The flow of the refrigerant, which swirls between the blade passing zone and the blade non-passing zone, will be hereinafter referred to as a swirl flow. The flow rate of the swirl flow is relatively high in the blade passing zone and also in an outer peripheral part of the blade non-passing zone. However, the flow rate of the swirl flow is slowed down toward the center of the blade non-passing zone and becomes substantially zero at or around the center of the blade non-passing zone. Thus, as in the case of the swirl flow of the regenerative pump 100 shown in FIG. 10 or 11, when the center of the swirl flow is displaced away from an axial side outer edge of the blade 101 (a left side edge of the blade 101 in FIG. 10 or 11) into the blade non-passing zone, the blade non-passing zone has a non-returning region, from which the fluid does not return to the blade passing zone. Here, the axial side outer edge of the blade 101 is defined as an outer edge of the blade 101, which is located in one end of the blade 101 (a left end of the blade 101 in FIG. 10 or 11) in a direction parallel to a rotational axis of the blades 101. The fluid placed in the non-returning region cannot receive the kinetic energy from the blades 101, so that the flow rate of the mainstream of the fluid decreases. As a result, a discharge rate of the regenerative pump 100 decreases, and thereby a pump efficiency of the regenerative pump 100 decreases.

Even when the center of the swirl flow is shifted toward the axial side outer edge of the blade 101 to reduce a size of the non-returning region, the pump efficiency of the regenerative pump 100 may be reduced due to an inappropriate ratio between the blade non-passing zone cross sectional area and the blade passing zone cross sectional area.

For example, when the blade non-passing zone cross sectional area is too small relative to the blade passing zone cross sectional area, an area, through which the fluid can move in the flow direction of the mainstream of the fluid, becomes small. Thus, the flow rate of the fluid in the flow direction of the mainstream becomes too large. As a result, friction loss caused by a wall of the fluid passage becomes large, and thereby the pump efficiency of the regenerative pump 100 is reduced. This is typical in a case where the fluid is discharged from the regenerative pump 100 at the low pressure.

In contrast, when the blade non-passing zone cross sectional area is too large relative to the blade passing zone cross sectional area, a non-swirl area, in which the substantial swirl flow does not exist, will be generated at a radial inner wall of the fluid passage, as shown in FIG. 7. The fluid in the non-swirl area cannot receive the kinetic energy from the blades 101. Thus, the flow rate in the flow direction of the mainstream is reduced. In this way, the discharge rate of the regenerative pump 100 is reduced, and thereby the pump efficiency of the regenerative pump 100 is reduced. This is typical in a case where the fluid is discharged from the regenerative pump 100 at the high pressure.

SUMMARY OF THE INVENTION

The present invention addresses the above disadvantages. Thus, it is an objective of the present invention to provide a regenerative pump which can provide an improved pump efficiency.

To achieve the objective of the present invention, there is provided a regenerative pump that includes a casing and an impeller. The casing forms a generally annular fluid passage, which conducts a fluid. The impeller is rotatably received in the casing and has a plurality of blades, which are arranged one after another in a circumferential direction to provide kinetic energy to the fluid in the fluid passage upon rotation of the impeller. The regenerative pump satisfies a relationship of $0.60 \leqq b/a \leqq 0.76$, where "a" is an axial width of each blade, and "b" is a total axial distance, which is a sum of a first axial distance between a first axial side outer edge of the blade and an opposed first axial side inner wall of the fluid passage and a second axial distance between a second axial side outer edge of the blade and an opposed second axial side inner wall of the fluid passage.

BRIEF DESCRIPTION OF THE DRAWINGS

The invention, together with additional objectives, features and advantages thereof, will be best understood from the following description, the appended claims and the accompanying drawings in which:

FIG. 4 is a graph showing a relationship between a maximum efficiency of the pump and b/a;

DETAILED DESCRIPTION OF THE INVENTION

A regenerative pump 1 according to an embodiment of the present invention will be described with reference to the accompanying drawings. The regenerative pump 1 of the present embodiment is a pump, in which a plurality of blades 3 is driven in an annular fluid passage 2 to provide kinetic energy to a fluid supplied into the fluid passage 2. The regenerative pump 1 is used to, for example, supply air to exhaust gas discharged from an internal combustion engine (not shown) to reduce emissions contained in the exhaust gas.

Figure 1:
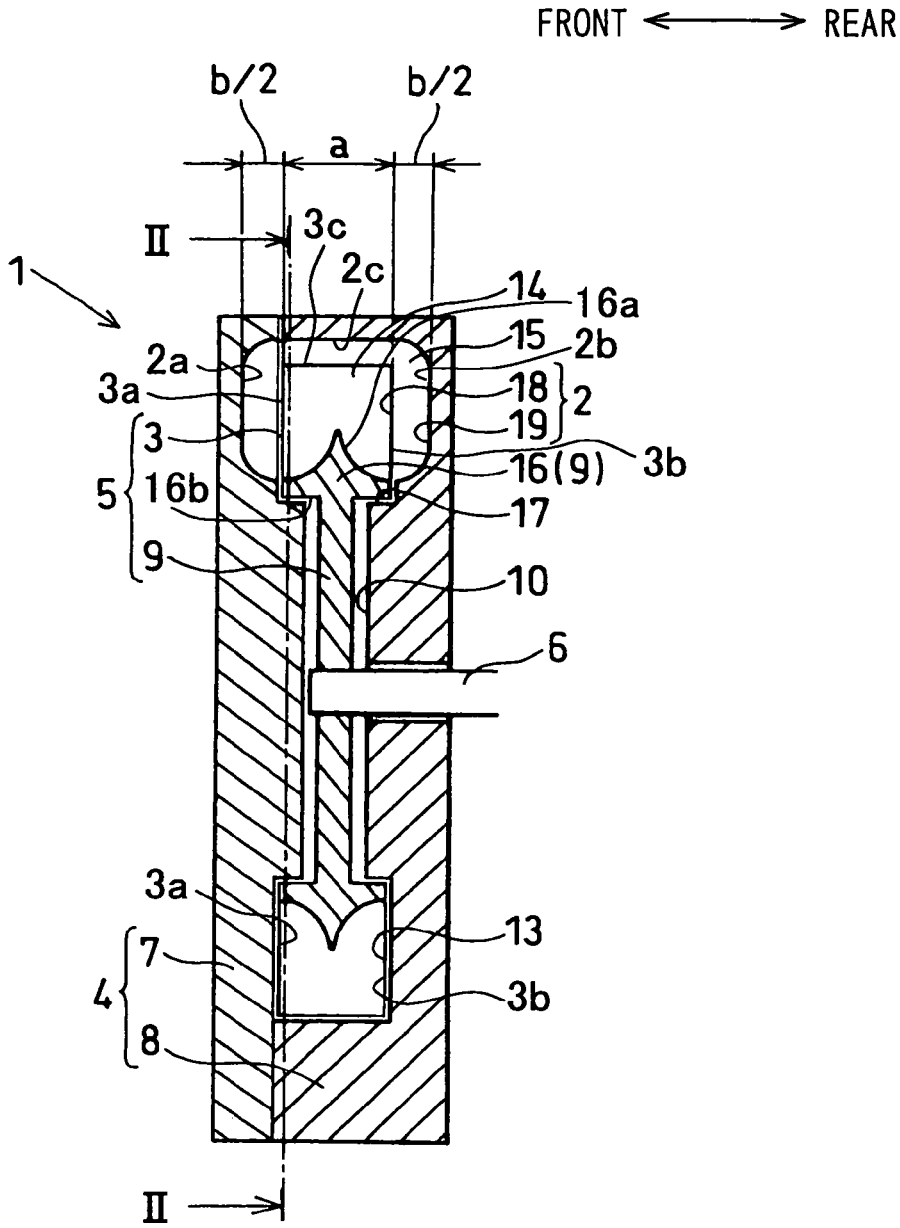
FIG. 1 is a cross sectional view of a regenerative pump according to an embodiment of the present invention.
Figure 2:
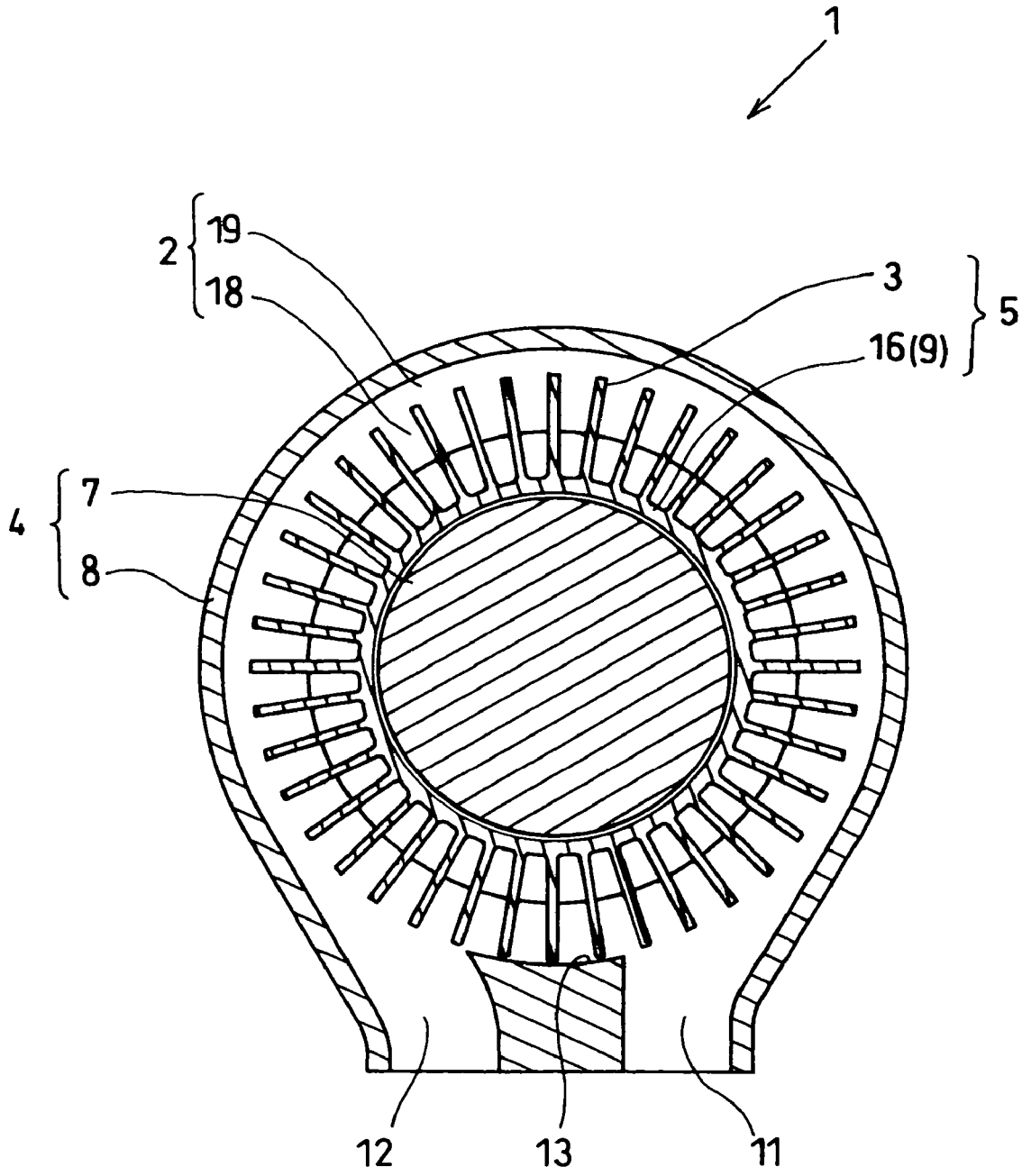
FIG. 2 is a cross sectional view taken along line II—II in FIG. 1.

As shown in FIGS. 1 and 2, the regenerative pump 1 includes a casing 4, an impeller 5 and a drive shaft 6. The casing 4 forms the fluid passage 2. The impeller 5 is received in the casing 4. Furthermore, the impeller 5 is formed into a circular disk body that is provided with the blades 3. The blades 3 are arranged one after another in a circumferential direction of the circular disk body and supply kinetic energy to the fluid in the fluid passage 2. The drive shaft 6 is rotated to drive the impeller 5.

Figure 3:
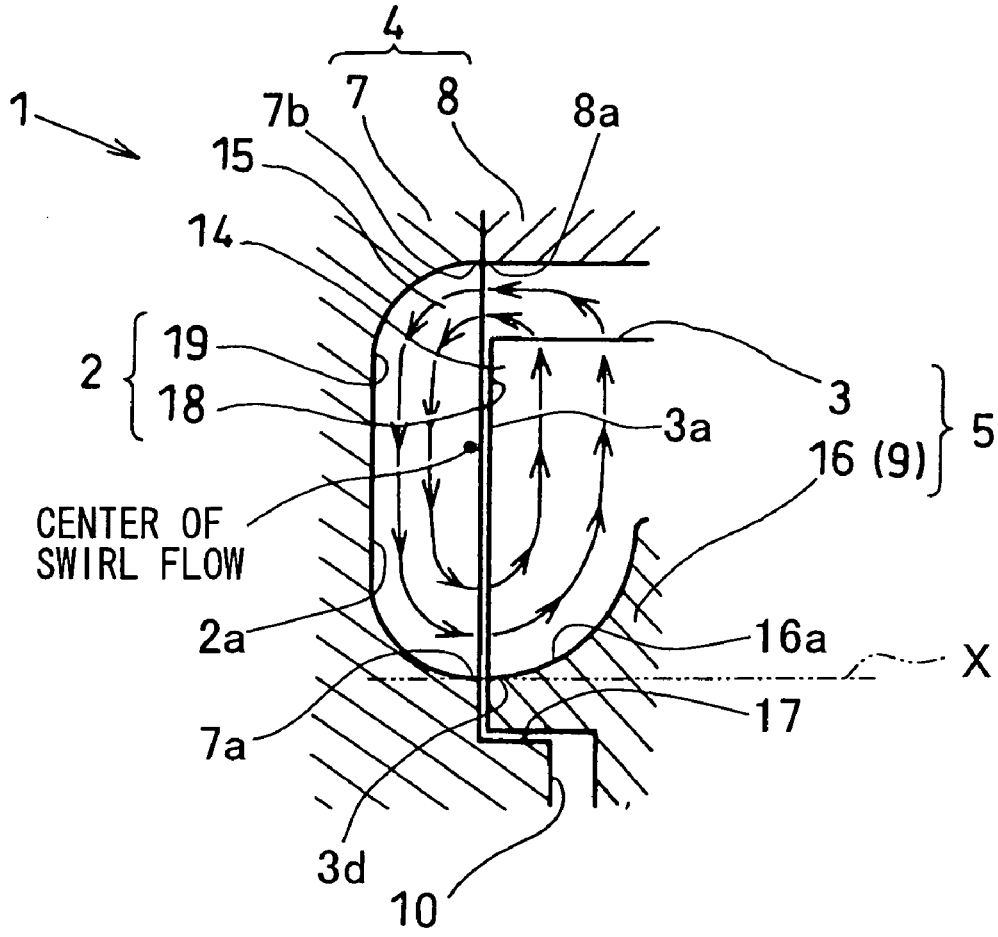
FIG. 3 is a partially enlarged view of FIG. 1, showing a swirl flow in a fluid passage of the regenerative pump.

As shown in FIG. 1, the casing 4 includes a front or first axial member 7 and a rear or second axial member 8, which are formed separately and are arranged on front and rear sides, respectively, of the casing 4. As shown in FIGS. 1 and 2, first axial member 7 and the second axial member 8 are connected together to form the generally annular fluid passage 2. The casing 4 further has an impeller main body receiving portion 10, an intake passage 11, a discharge passage 12 and a narrow passage portion 13. The fluid passage 2 receives the blades 3. The impeller main body receiving portion 10 receives an impeller main body 9 of the impeller 5. The front-rear direction of the regenerative pump 1 coincides with a left-right direction in FIG. 1. Furthermore, the front-rear direction coincides with an axial direction of the impeller 5, i.e., a direction of a rotational axis of the impeller 5. As illustrated in FIG 3, an imaginary tangential line that contacts a surface of an axial inner end 7*b* of a radially outer end side curved wall of the fluid passage 2 of the first axial member 7 at a connection between the surface of the axially inner end 7*b* and a surface of an axially opposed end 8*a* of a radially outer end side wall 2*c* of fluid passage 2 of the second axial member 8, extends parallel to the rotational axis of the impeller 5.

With reference to FIG. 1, a cross section of the fluid passage 2, which is perpendicular to a flow direction of a mainstream of the fluid, has a blade passing zone cross sectional area 14 and a blade non-passing zone cross sectional area 15. The blade passing zone cross sectional area 14 has a generally rectangular shape, in which two generally quarter-rounds are symmetrically arranged in the front-rear direction. The blade non-passing zone cross sectional area 15 has a shape that includes a semi-round portion and a linear portion on each of the front side and the rear side in a symmetrical manner. Here, the flow direction of the mainstream of the fluid is a direction along a center line of the fluid passage 2. Also, the blade passing zone cross sectional area 14 refers to a portion of the cross section of the fluid passage 2, which is perpendicular to the flow direction of the mainstream of the fluid and through which the blades 3 pass. The blade non-passing zone cross sectional area 15 refers to a portion of the cross section of the fluid passage 2, which is perpendicular to the flow direction of the mainstream of the fluid and through which the blades 3 do not pass. The blade passing zone cross sectional area 14 and the blade non-passing zone cross sectional area 15 cooperate together to form the cross section of the fluid passage 2.

The narrow passage portion 13 refers to a portion of the interior of the housing 4, which is located between the intake passage 11 and the discharge passage 12 and receives the corresponding blades 3. As shown in FIG. 1, a clearance between each axial side inner wall of the narrow passage portion 13 and an opposed one of axial side outer edges 3*a*, 3*b* of each corresponding blade 3 is set to a predetermined small value to effectively discharge the fluid, which receives the kinetic energy and is pressurized. Thus, a cross section of the narrow passage portion 13 has a generally rectangular shape, which corresponds to the shape of the blade 3.

As shown in FIGS. 1 and 2, the impeller 5 includes the circular disk shaped impeller main body 9 and the blades 3. The impeller main body 9 is rotated by the drive shaft 6. The blades 3 extend radially outward from a radially outer edge of the impeller main body 9 and are arranged one after another in the circumferential direction in the fluid passage 2.

With reference to FIG. 3, the impeller 5 further includes a plurality of impeller main body portions joined to and extending between the radially inner ends of circumferentially adjacent blades 3. A surface of an axially inner end 7*a* of a radially inner end side curved wall of the fluid passage 2 and a surface of an adjacent axially outer end 3*d* of each of the plurality of impeller main body portions extend along an imaginary common curve in such a manner that an imaginary tangential line X which contacts the imaginary curve at an intermediate point between the surface of the axially inner end 7*a* and the surface of the adjacent axially outer end 3*d* extends parallel to a rotational axis of the impeller.

As shown in FIG. 1, the impeller main body 9 includes an outer peripheral portion 16, which is thickened in the axial direction relative to the rest of the impeller main body 9. The outer peripheral portion 16 is received in a stepped portion 17, which is located in the radially outer edge of the impeller main body receiving portion 10 in such a manner that a predetermined axial clearance and a predetermined radial clearance are provided between the outer peripheral portion 16 and the stepped portion 17. A radially outer edge 16*a* of the outer peripheral portion 16 is recessed to form two quarter-rounds, which are arranged symmetrically with respect to the axial center of the outer peripheral portion 16 in the front-rear direction in the cross section of the outer peripheral portion 16. Thus, the axial center of the radially outer edge 16*a* of the outer peripheral portion 16 forms a peak in the cross section. Furthermore, each of the opposed axial ends of the radially outer edge 16*a* of the outer peripheral portion 16 forms a smooth connection to a corresponding opposed axial side inner wall 2*a*, 2*b* of the fluid passage 2. In this way, as shown in FIG. 3, a swirl flow is generated without forming an abnormally stagnated area in a blade passing zone 18. Here, the blade passing zone 18 refers to a portion of the fluid passage 2, through which the blades 3 pass. By contrast, a portion of the fluid passage 2, through which the impeller 5 including the blades 3 does not pass, will be referred to as a blade non-passing zone 19. Furthermore, the flow of fluid, which swirls between the blade passing zone 18 and the blade non-passing zone 19, will be referred to as a swirl flow.

The stepped portion 17 is formed along an inner peripheral side of the fluid passage 2. A portion of the stepped portion 17, which is formed along an inner peripheral side of the narrow passage portion 13, forms a part of the narrow passage portion 13 to define a portion of the generally rectangular cross section of the narrow passage portion 13. Similar to the axial side outer edges 3*a*, 3*b* of the blades 3, a small clearance is formed between an inner wall of the stepped portion 17 and each axial side outer edge of the outer peripheral portion 16, and also a small clearance is formed between the inner wall of the stepped portion 17 and a radially inner edge 16*b* of the outer peripheral portion 16.

As shown in FIG. 1, similar to the blade passing zone cross sectional area 14, each blade 3 has a generally rectangular cross section. Furthermore, each blade 3 extends linearly and outwardly from the axially outer edge 16*a* of the outer peripheral portion 16 in the radial direction, as shown in FIG. 2. The recessed spaces, each of which is defined between the corresponding adjacent two blades 3, constitute the blade passing zone 18. As shown in FIG. 1, a radially outer space, which is defined between radially outer edges 3*c* of the blades 3 and the opposed radial inner wall 2*c* of the fluid passage 2, forms a part of the blade non-passing zone 19. Also, a first axial side space (a front side space), which is defined between the first axial side outer edges 3*a* of the blades 3 (the left side edges of the blades 3 in FIG. 1) and the opposed first axial side inner wall 2*a* of the fluid passage 2, forms another part of the blade non-passing zone 19. Furthermore, a second axial side space (a rear side space), which is defined between the second axial side outer edges 3*b* of the blades 3 (the right side edges of the blades 3 in FIG. 1) and the opposed second axial side inner wall 2*b* of the fluid passage 2, forms another part of the blade non-passing zone 19. In the present embodiment, the first axial side inner wall 2*a* of the fluid passage 2 is generally parallel to the second axial side inner wall 2*b* of the fluid passage 2.

As shown in FIG. 1, the drive shaft 6 extends through the rear member 8 and is connected to the center of the impeller main body 9. A rotational torque is transmitted from an electric motor (not shown) to the impeller main body 9 through the drive shaft 6 to rotate the impeller main body 9.

Characteristic features of the regenerative pump 1 of the present embodiment will be described with reference to the accompanying drawings. First, with reference to FIG. 1, the regenerative pump 1 satisfies a relationship of $0.60 \leqq b/a \leqq 0.76$, where "a" is an axial width of each blade 3, and "b" is a total axial distance, which is a sum of a first axial distance (b/2) between the first axial side outer edge 3*a* of the blade 3 and the opposed first axial side inner wall 2*a* of the fluid passage 2 and a second axial distance (b/2) between the second axial side outer edge 3*b* of the blade 3 and the opposed second axial side inner wall 2*b* of the fluid passage 2. In the present embodiment, b/a is 0.68. In the present embodiment, the first axial side space (the front side space), which is defined between the first axial side inner wall 2*a* of the fluid passage 2 and the first axial side outer edges 3*a* of the blades 3, is symmetrical with the second axial side space (the rear side space), which is defined between the second axial side inner wall 2*b* of the fluid passage 2 and the second axial side outer edges 3*b* of the blades 3. Thus, the sum of the first axial distance (b/2) of the first axial side space and the second axial distance (b/2) of the second axial side space is defined as the total axial distance (b).

Furthermore, the regenerative pump 1 also satisfies a relationship of $1.0 \leqq S2/S1 \leqq 1.2$, where "S1" is a size of the blade passing zone cross sectional area 14, and "S2" is a size of the blade non-passing zone cross sectional area 15. In the present embodiment, S2/S1 is 1.1.

Also, the shape of each blade 3 is generally rectangular.

Operation of the regenerative pump 1 of the present embodiment will be described. The blades 3 of the regenerative pump 1 of the present embodiment are rotated by the drive shaft 6 in a counterclockwise direction in FIG. 2. The air, which serves as the fluid of the present embodiment, is drawn into the fluid passage 2 through the intake passage 11. Furthermore, the air, which is drawn into the fluid passage 2, flows into one of the recessed spaces (hereinafter simply referred to as recesses), each of which forms a part of the blade passing zone 18 and each of which is defined between the corresponding adjacent two blades 3. The air flown into the recess receives the kinetic energy from the corresponding blade 3 and thus swirls from the blade passing zone 18 to the blade non-passing zone 19. Next, the air, which is swirled into the blade non-passing zone 19, flows into the next recess in the counterclockwise direction while forming the swirl flow and receives the kinetic energy once again from the corresponding blade 3. Then, the air swirls from the blade passing zone 18 to the blade non-passing zone 19 and moves to the next recess, and so on. Finally, the air reaches the discharge passage 12 and is discharged from the regenerative pump 1 through the discharge passage 12. In this way, the air is pressurized to the predetermined pressure.

The present embodiment achieves the following advantages. In the present embodiment, b/a is 0.68, so that the relationship of $0.60 \leqq b/a \leqq 0.76$ is satisfied. In this way, the ratio between "a" and "b" is appropriately maintained, and the center of the swirl flow can be positioned closer to the corresponding axial side outer edge 3*a*, 3*b* of the blade 3.

Figure 4:
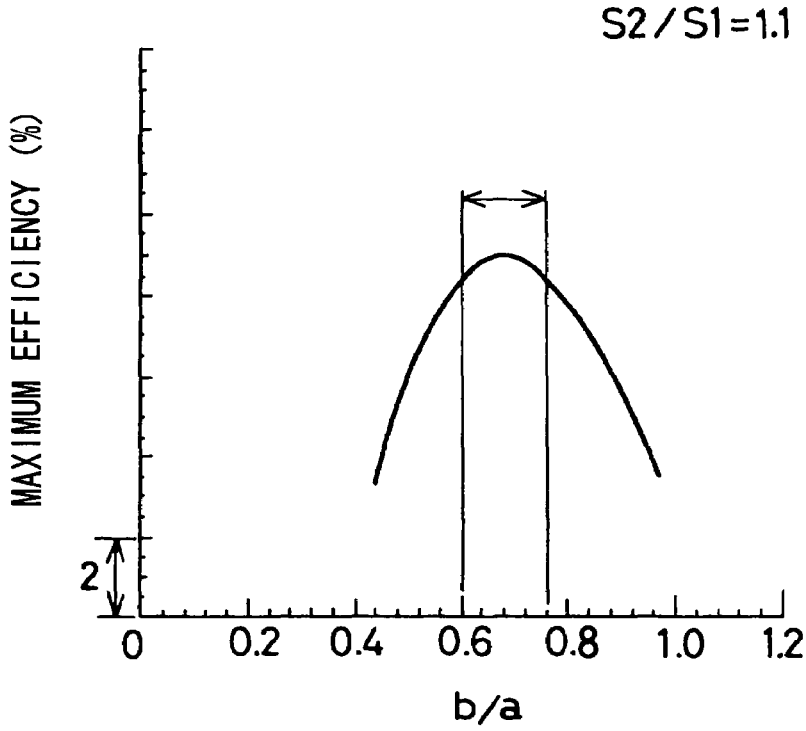
Figure 6:
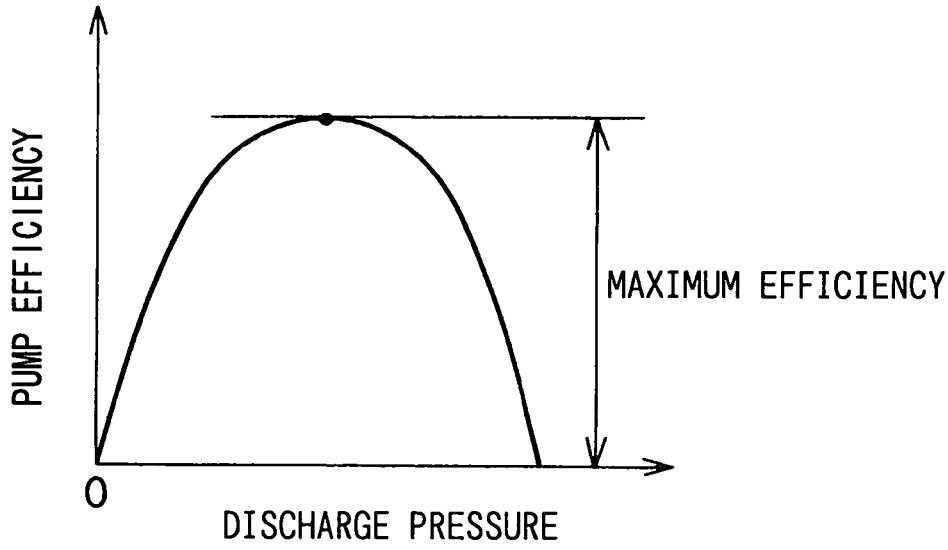
FIG. 6 is a graph showing a relationship between a pump efficiency and a discharge pressure.
Figure 10:
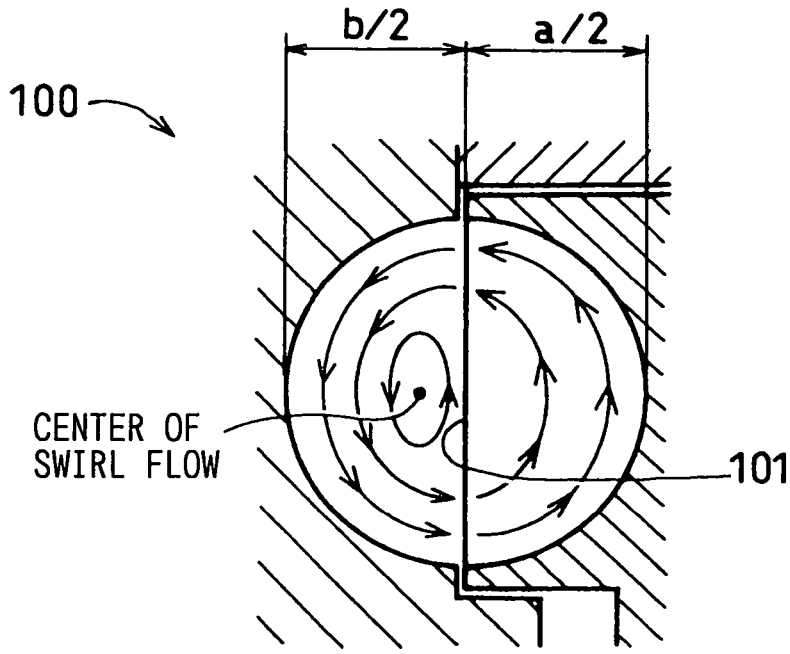
FIG. 10 RELATED ART
FIG. 10 is a partial enlarged view of FIG. 8 showing a swirl flow generated in a fluid passage of the regenerative pump.
Figure 11:
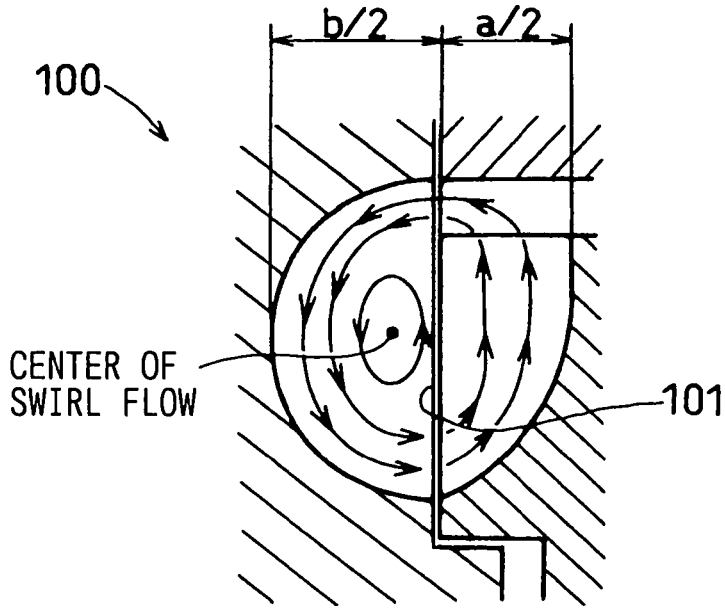
FIG. 11 RELATED ART
FIG. 11 is a partial enlarged view of FIG. 9 showing a swirl flow generated in a fluid passage of the regenerative pump.

That is, in the previously proposed regenerative pump, as shown in FIGS. 10 and 11, "b" is too large relative to "a", so that the center of the swirl flow is positioned apart from the axial side outer edge of the blade in the blade non-passing zone. However, with reference to FIG. 4, when the relationship of $b/a \leqq 0.76$ is satisfied, the center of the swirl flow can be placed closer to the axial side outer edge of the blade 3 to reduce the non-returning region, from which the fluid does not return to the blade passing zone 18, thereby limiting a reduction in the pump efficiency. The maximum efficiency of FIG. 6, which is achieved at the time of changing the discharge pressure, is used as a measure of pump performance measured at a predetermined value of b/a or a predetermined value of S2/S1.

Figure 7:
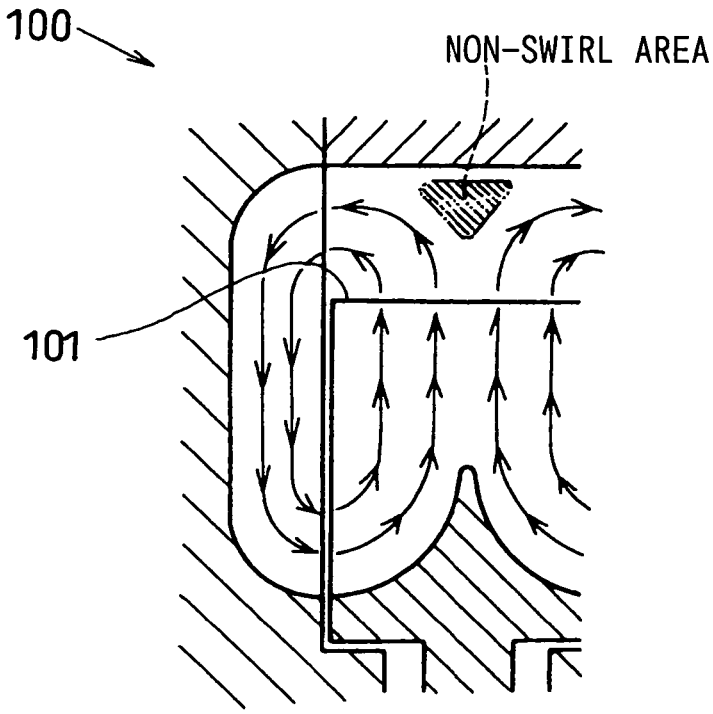
FIG. 7 RELATED ART
FIG. 7 is a descriptive view showing a non-swirl area, in which a substantial swirl flow does not exist, at radial inner wall of a fluid passage of a comparative example.
Figure 8:
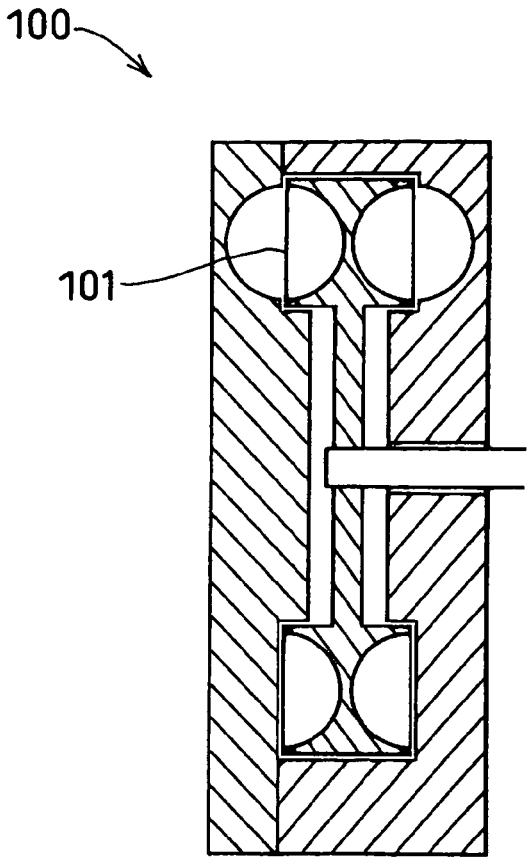
FIG. 8 RELATED ART
FIG. 8 is a cross sectional view of a previously proposed regenerative pump.
Figure 9:
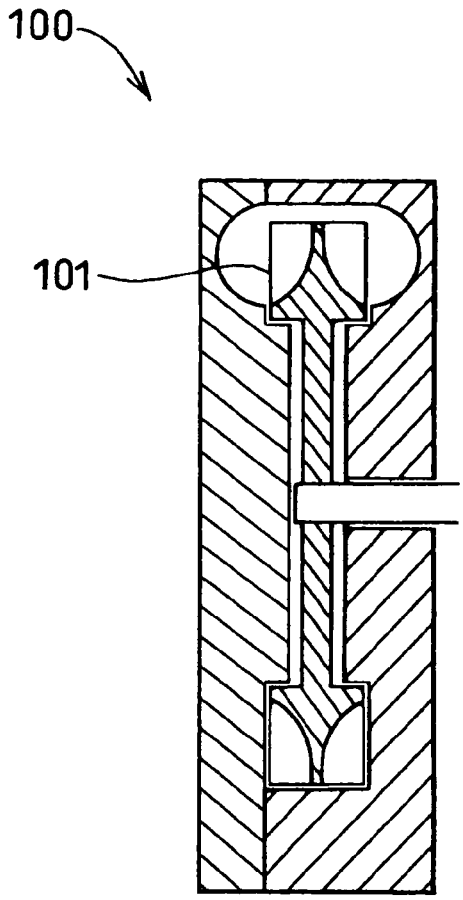
FIG. 9 RELATED ART
FIG. 9 is a cross sectional view of another previously proposed regenerative pump.

In the case where "b" is too small relative to "a", when a substantial gap is formed between the radially outer edge of the blade and the opposed radial inner wall of the fluid passage, the non-swirl area, in which the substantial swirl flow does not exist, is generated near the radial inner wall of the fluid passage, as shown in FIG. 7. Thus, the flow rate of the fluid in the flow direction of the mainstream is reduced to reduce the pump efficiency. However, with reference to FIG. 4, when the relationship of $0.60 \leqq b/a$ is satisfied, the above problems can be alleviated to limit a reduction in the pump efficiency.

In the present embodiment, S2/S1 is 1.1, so that the relationship of $1.0 \leqq S2/S1 \leqq 1.2$ is satisfied. In this way, the ratio between the size S1 of the blade passing zone cross sectional area 14 and the size S2 of the blade non-passing zone cross sectional area 15 is maintained in an appropriate manner to limit a reduction in the pump efficiency.

Figure 5:
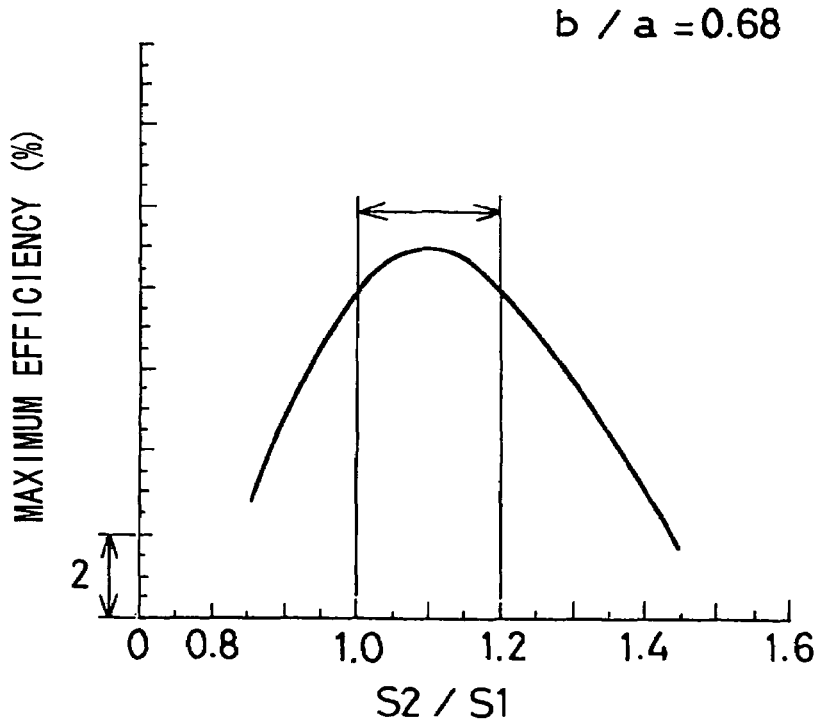
FIG. 5 is a graph showing a relationship between a maximum efficiency of the pump and S2/S1.

That is, when S2 is too small relative to S1, the area, through which the air can move in the flow direction of the mainstream, becomes small, so that the flow rate of the air in the flow direction of the mainstream becomes too large. Thus, the friction loss induced by the wall of the fluid passage becomes large, and the pump efficiency is reduced. However, as shown in FIG. 5, when the relationship of $1.0 \leqq S2/S1$ is satisfied, the problem can be alleviated to limit a reduction in the pump efficiency.

In contrast, when S2 is too large relative to S1, the non-swirl area, in which the substantial swirl flow does not exist, is generated near the radial inner wall of the fluid passage, as shown in FIG. 7. Thus, the flow rate of the fluid in the flow direction of the mainstream is reduced to reduce the pump efficiency. However, as shown in FIG. 5, when the relationship of $S2/S1 \leqq 1.2$ is satisfied, the problem can be alleviated to limit a reduction in the pump efficiency.

In the present embodiment, the shape of each blade 3 is generally rectangular. Therefore, the cross section of the narrow passage portion 13 can be formed into the rectangular shape to allow easy manufacturing and assembling of the casing 4.

The above embodiment can be modified as follows.

In the regenerative pump 1 of the above embodiment, the blade passing zone cross sectional area 14 has the shape, in which the two generally quarter-rounds are symmetrically arranged in the front-rear direction. Furthermore, the blade non-passing zone 15 has the shape that includes the generally semi-round portion and the linear portion on each of the front side and the rear side in the symmetrical manner. However, the present invention is not limited to this structure. For example, the blade passing zone cross sectional area 14 can be formed into a semi-round shape, and the blade non-passing zone cross sectional area 15 can be formed into a semi-round shape. The semi-round shaped blade passing zone cross sectional area 14 and the semi-round shaped blade non-passing zone cross sectional area 15 can be symmetrically arranged in the front-rear direction or can be asymmetrically arranged like in the above embodiment or in the above modification.

The regenerative pump 1 of the present embodiment is a radial centrifugal pump, in which each blade 3 extends linearly and outwardly from the radially outer edge 16*a* of the outer peripheral portion 16 in the radial direction. However, each blade 3 can be a forward blade, which is tilted in the rotational direction, or can be a backward blade, which is tilted in the direction opposite from the rotational direction. Furthermore, multiple blades can be arranged one after another in the axial direction. Also, the pump of the above embodiment is not limited to the centrifugal pump and can be an axial-flow pump or a diagonal pump.

In the above embodiment, the air is used as the fluid to be pressurized. However, the fluid to be pressurized is not limited to the air and can be liquid, such as water or can be a two-phase fluid. The two-phase fluid can be a gas-liquid fluid, a solid-gas fluid (e.g., mixture of power and gas) or a solid-liquid fluid (e.g., slurry).

In the above embodiment, the shape of each blade 3 is generally rectangular. However, the shape of each blade 3 can be any other appropriate shape. For example, a portion of the radially outer edge 3*c* of the blade 3 can be recessed or can be protruded. Also, the entire radially outer edge 3*c* of the blade 3 can have a smooth curved edge line.

Additional advantages and modifications will readily occur to those skilled in the art. The invention in its broader terms is therefore not limited to the specific details, representative apparatus, and illustrative examples shown and described.

What is claimed is:

1. A regenerative pump comprising:

a casing that forms a generally annular fluid passage, which conducts a fluid; and an impeller that is rotatably received in the casing and has a plurality of blades, which are arranged one after another in a circumferential direction to provide kinetic energy to the fluid in the fluid passage upon rotation of the impeller, wherein the regenerative pump satisfies a relationship of $0.60 \leqq b/a \leqq 0.76$, where "a" is an axial width of each blade, and "b" is a total axial distance, which is a sum of a first axial distance between a first axial side outer edge of the blade and an opposed first axial side inner wall of the fluid passage and a second axial distance between a second axial side outer edge of the blade and an opposed second axial side inner wall of the fluid passage; and the regenerative pump satisfies a relationship of $1.0 \leqq S2/S1 \leqq 1.2$ where "S1" is a size of a blade passing zone cross sectional area of the fluid passage, which is perpendicular to a flow direction of a mainstream of the fluid in the fluid passage and through which the blades pass, and "S2" is a size of a blade non-passing zone cross sectional area of the fluid passage, which is perpendicular to the flow direction of the mainstream of the fluid in the fluid passage and through which the blades do not pass, the impeller further including a plurality of impeller main body portions each of which is joined to a radially inner end of a corresponding one of the plurality of blades and extends between circumferentially adjacent blades, a surface of an axially inner end of a radially inner end side curve wall of the fluid passage and a surface of an adjacent axially outer end of each of the plurality of impeller main body portions extend along an imaginary common curve in such a manner that an imaginary tangential line X which contacts the imaginary curve at an intermediate point between the surface of the axially inner end of the radially inner end side curved wall of the fluid passage and the surface of the adjacent axially outer end of each of the plurality of impeller main body portions extends parallel to a rotational axis of the impeller.

2. The regenerative pump according to claim 1, wherein each blade has a generally rectangular shape.

3. The regenerative pump according to claim 1, wherein the first axial side inner wall of the fluid passage is generally parallel to the second axial side inner wall of the fluid passage.

4. The regenerative pump according to claim 1, wherein the casing includes a first axial member and a second axial member which are connected together to form the generally annular fluid passage, and an imaginary tangential line, which contacts the surface of an axially inner end of a radially outer end side curved wall of the fluid passage of the first axial member at a connection between the surface of the axially inner end of the radially outer end side curved wall of the fluid passage of the first axial member and a surface of an axially opposed end of a radially outer end side wall of the fluid passage of the second axial member, extends parallel to the rotational axis of the impeller.

* * * * *